US008024885B1

(12) United States Patent
Newhall et al.

(10) Patent No.: US 8,024,885 B1
(45) Date of Patent: Sep. 27, 2011

(54) LENS COVER FOR AN OPTICAL SIGHT

(75) Inventors: Thomas A. Newhall, Tucson, AZ (US); Mark A. Newhall, Tucson, AZ (US)

(73) Assignee: GG & G, Inc., Tucson, AZ (US)

( * ) Notice: Subject to any disclaimer, the term of this patent is extended or adjusted under 35 U.S.C. 154(b) by 225 days.

(21) Appl. No.: 11/398,180

(22) Filed: Apr. 5, 2006

Related U.S. Application Data

(60) Provisional application No. 60/668,686, filed on Apr. 6, 2005.

(51) Int. Cl.
*G02B 23/16* (2006.01)

(52) U.S. Cl. ..... 42/129; 42/143; 359/511; 359/612

(58) Field of Classification Search ..... 42/129, 42/143; 359/511, 611, 612; 396/448
See application file for complete search history.

(56) References Cited

U.S. PATENT DOCUMENTS

| | | | | |
|---|---|---|---|---|
| 35,456 | A | | 6/1862 | Leverich |
| 1,650,517 | A | | 11/1927 | Hughes |
| 2,207,857 | A | * | 7/1940 | Gregery ..... 42/111 |
| 2,362,887 | A | * | 11/1944 | Corte ..... 89/37.22 |
| 2,488,188 | A | | 11/1949 | Halvorson |
| 2,514,257 | A | * | 7/1950 | Reavis ..... 42/129 |
| 2,522,897 | A | | 9/1950 | Rotter |
| 2,581,459 | A | * | 1/1952 | Tyra ..... 356/247 |
| 2,599,689 | A | | 6/1952 | Brelsford |
| 2,632,252 | A | | 3/1953 | Blais, Sr. |
| 2,696,672 | A | | 12/1954 | Durfee |
| 2,738,585 | A | | 3/1956 | Vissing |
| 2,849,795 | A | | 9/1958 | Vissing |
| 2,889,629 | A | | 6/1959 | Darkenwald |
| 2,932,334 | A | | 4/1960 | Steen |
| 3,015,982 | A | | 1/1962 | Bing |
| 3,131,477 | A | | 5/1964 | Thomas |
| 3,208,146 | A | | 9/1965 | Nelson |
| 3,426,433 | A | | 2/1969 | Anderson |

(Continued)

*Primary Examiner* — Stephen M Johnson
(74) *Attorney, Agent, or Firm* — Lawrence R. Oremland, P.C.

(57) ABSTRACT

A unique, new and useful structure designed to simply and efficiently cover and protect the lens of a sight, especially a firearm sight such as the hooded models of the EO Tech Holosight type 511, 512, 551, and 552 models. A lens cover comprises a housing with a pair of lens openings, and a pair of lens covers, one for each lens opening. The housing has a recess for receiving the lens covers, and each lens cover is biased toward the recess and is moveable against its bias to a position in which it covers a respective lens opening in the housing. In a preferred embodiment, the recess and the lens covers are configured such that (i) the lens covers can be received and oriented in the recess in a predetermined relation with each other and (ii) the lens covers can be efficiently manipulated when they are not received in the recess in the predetermined relation to cause them to be reoriented and received in the recess in the predetermined relation. Further each lens cover is pivotally supported on the housing in a manner that enables the lens cover to be pivoted toward and into the recess and to be pivoted relative to the housing as the lens cover is moved against its bias and to a position in which it covers a respective lens. Also, the lens covers are offset in relation to their pivot axes in a manner that enables them to be received and oriented in the predetermined relation, and oriented in a manner that enables them to be efficiently manipulated and reoriented when they are not received in the recess in the predetermined relation.

5 Claims, 6 Drawing Sheets

U.S. PATENT DOCUMENTS

| | | | | | |
|---|---|---|---|---|---|
| 3,465,446 | A | | 9/1969 | Cox | |
| 3,496,642 | A | | 2/1970 | Pfahler | |
| 3,642,345 | A | | 2/1972 | Akin, Jr. | |
| 3,746,423 | A | | 7/1973 | Mills | |
| 3,831,285 | A | * | 8/1974 | Vissing | 42/129 |
| 3,840,883 | A | | 10/1974 | Choate | |
| 3,942,864 | A | | 3/1976 | Numbers | |
| 4,394,797 | A | | 7/1983 | Schuster | |
| 4,641,932 | A | | 2/1987 | Harms | |
| 4,858,361 | A | | 8/1989 | White | |
| 5,003,697 | A | | 4/1991 | Hampton | |
| 5,150,528 | A | | 9/1992 | Shire | |
| 5,495,676 | A | | 3/1996 | Chesnut | |
| 5,566,490 | A | | 10/1996 | Owen | |
| 5,631,772 | A | * | 5/1997 | Mizukawa | 359/511 |
| 5,954,507 | A | * | 9/1999 | Rod et al. | 434/19 |
| 6,041,508 | A | * | 3/2000 | David | 42/113 |
| 6,157,482 | A | * | 12/2000 | Koide | 359/408 |
| D445,475 | S | | 7/2001 | Spear | |
| 6,280,040 | B1 | * | 8/2001 | Koide | 359/600 |
| 6,418,657 | B1 | * | 7/2002 | Brown | 42/124 |
| 6,811,268 | B2 | | 11/2004 | Watson | |
| 7,234,570 | B1 | * | 6/2007 | Exely et al. | 188/137 |

* cited by examiner

LENS COVER FOR AN OPTICAL SIGHT

RELATED APPLICATION/CLAIM OF PRIORITY

This application is related to and claims priority from provisional application Ser. No. 60/668,686, filed Apr. 6, 2005, which provisional application is incorporated by reference herein.

BACKGROUND

The present invention relates to apparatus for handling (providing) a protective lens cover for an optical sight, particularly a firearm optical sight, capable of instant adjustment to permit unobstructed use of the optical sight. The present invention protects the lens from weather, dust, and contact with brush, trees, rocks, and the impact from certain types of training rounds.

A known type of firearm optical sight presently produced by EO TECH is the Holosight which includes models 511, 512, 551 and 552. The sight has a pair of lens at opposite sides of a housing. In the applicants' experience, the EOTECH Holosight does not have lens covers at the present time, and no company provides lens covers for the EOTECH. That is one reason why the present invention is believed to be important.

Applicants believe there is a need for a structure and method that can be integrated into as well as retrofitted to an existing sight device, such as an EO Tech Holosight type of firearm sight, and provide a simple, highly efficient, accurate and secure structure and method to quickly and easily cover and uncover the lens at the opposite ends of the sight that when opened provides unobstructed use of the sight.

SUMMARY OF THE PRESENT INVENTION

The present invention provides a unique, new and useful structure that addresses the foregoing issues. The structure is designed to simply and efficiently cover the lens of a sight, especially all hooded firearm sights such as the EO Tech Holosight type 511, 512, 551, and 552 sight.

A lens cover according to the present invention comprises a housing (preferably a rugged housing) with a pair of lens openings in a housing, and a pair of lens covers, one for each lens opening. The lens covers may be clear, colored, coated or opaque. The top of the housing has a recess (sometimes referred to as a resting recess) for receiving the lens covers, and each lens cover is biased toward the resting recess and is moveable against its bias to a position in which it covers a respective lens opening in the housing.

In a preferred embodiment, the recess and the lens covers are configured such that (i) the lens covers can be received and oriented in the resting recess in a predetermined relation with each other and (ii) the lens covers can be efficiently manipulated when they are not received in the recess in the predetermined relation to cause them to be reoriented and received in the recess in the predetermined relation. Further each lens cover is pivotally supported on the housing in a manner that enables the lens cover to be pivoted toward and into the recess and to be pivoted relative to the housing as the lens cover is moved against its bias and to a position in which it covers a respective lens.

Also, according to a preferred embodiment, a lens cover is maintained in the lens covering position by the pressure of integral spring detents upon finger tabs, the pressure of which must be overcome to open the lens covers. Also, the lens covers are offset in relation to their pivot axes in a manner that enables them to be received and oriented in the predetermined relation, and oriented in a manner that enables them to be efficiently manipulated and reoriented when they are not received in the recess in the predetermined relation. In addition, the preferred embodiment enables the lens covers to be manipulated by the "off hand" (a shooters term describing the hand that is not responsible for fire control).

Additional features of the present invention will become further apparent from the following detailed description and the accompanying drawings.

DETAILED DESCRIPTION

As discussed above, the present invention provides a lens cover structure that is useful with a sight, and particularly a firearm sight. A lens cover structure according to the present invention is particularly useful with all hooded EO Tech Holosights, and in particular models 511, 512, 551, and 552 type firearm sights, and is described herein in connection with such a firearm sight. However, from that description, the manner in which the principles of the present invention can be used to form lens cover structure for other types of optical sights will be apparent to those in the art.

Figure 1:
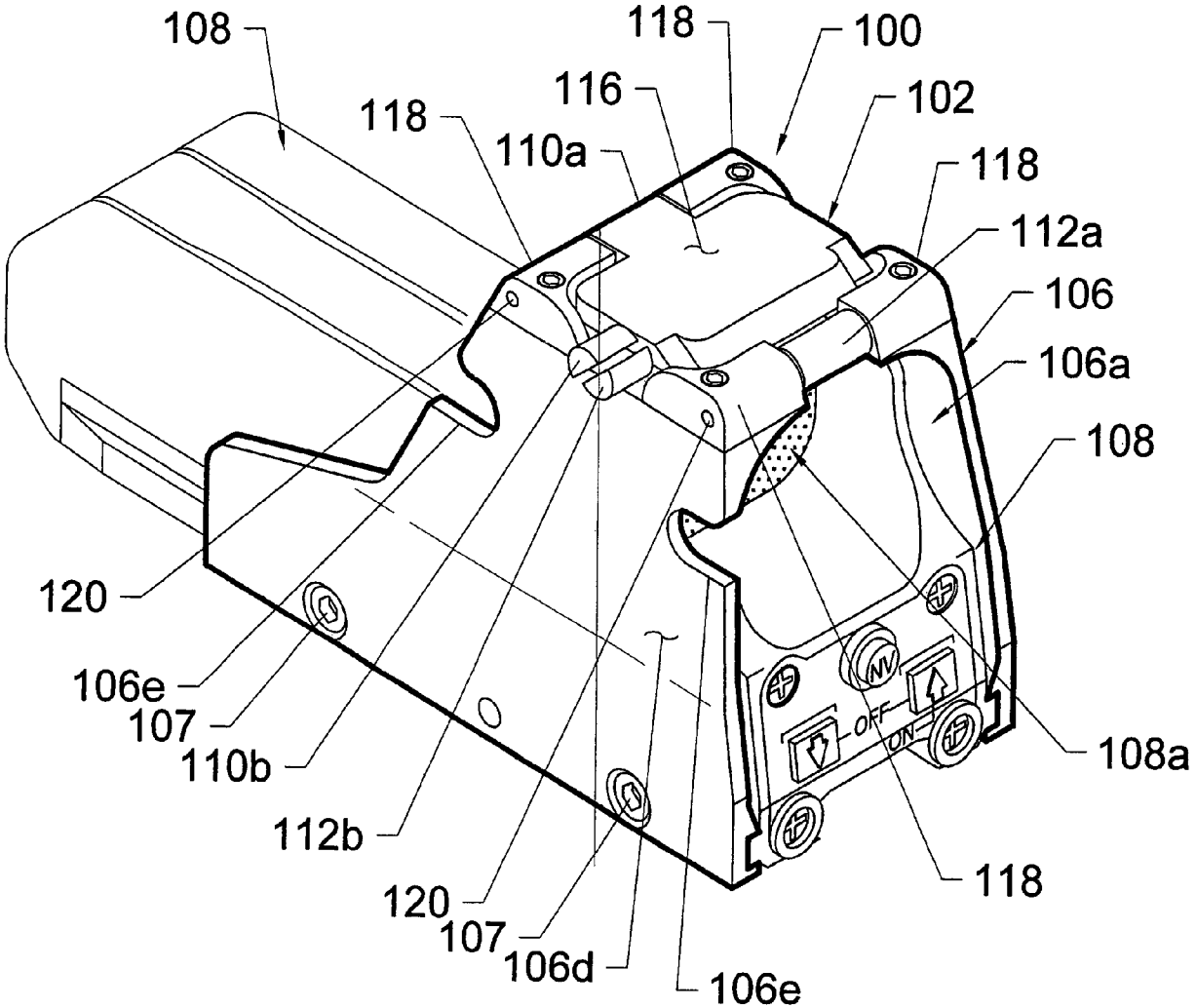
FIG. 1 is a schematic three dimensional illustration of a firearm sight with lens cover structure according to the principles of the present invention.
Figure 2:
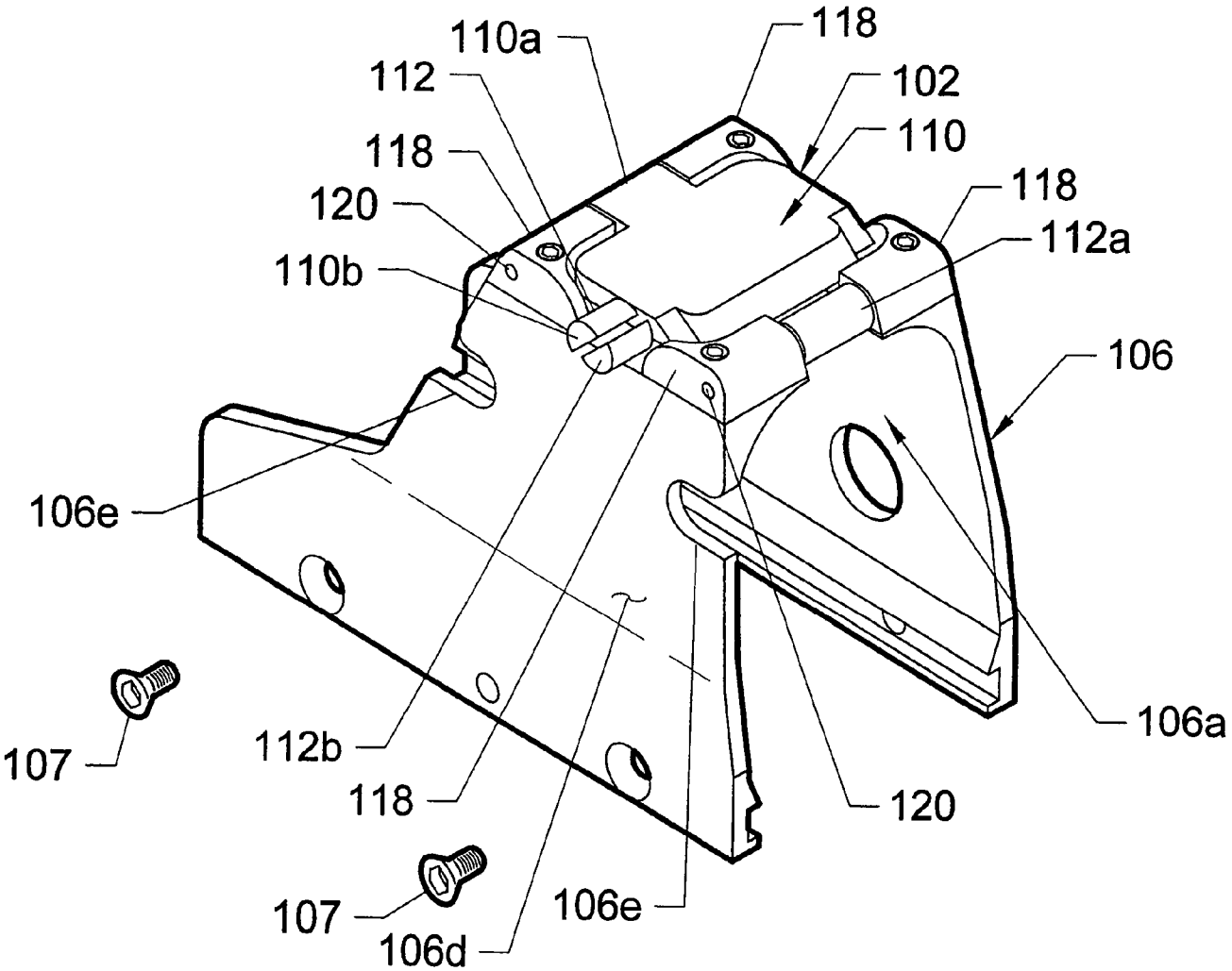
FIG. 2 is a three dimensional, partially exploded view of a firearm housing with lens cover structure according to the principles of the present invention.
Figures 3A, 3B:
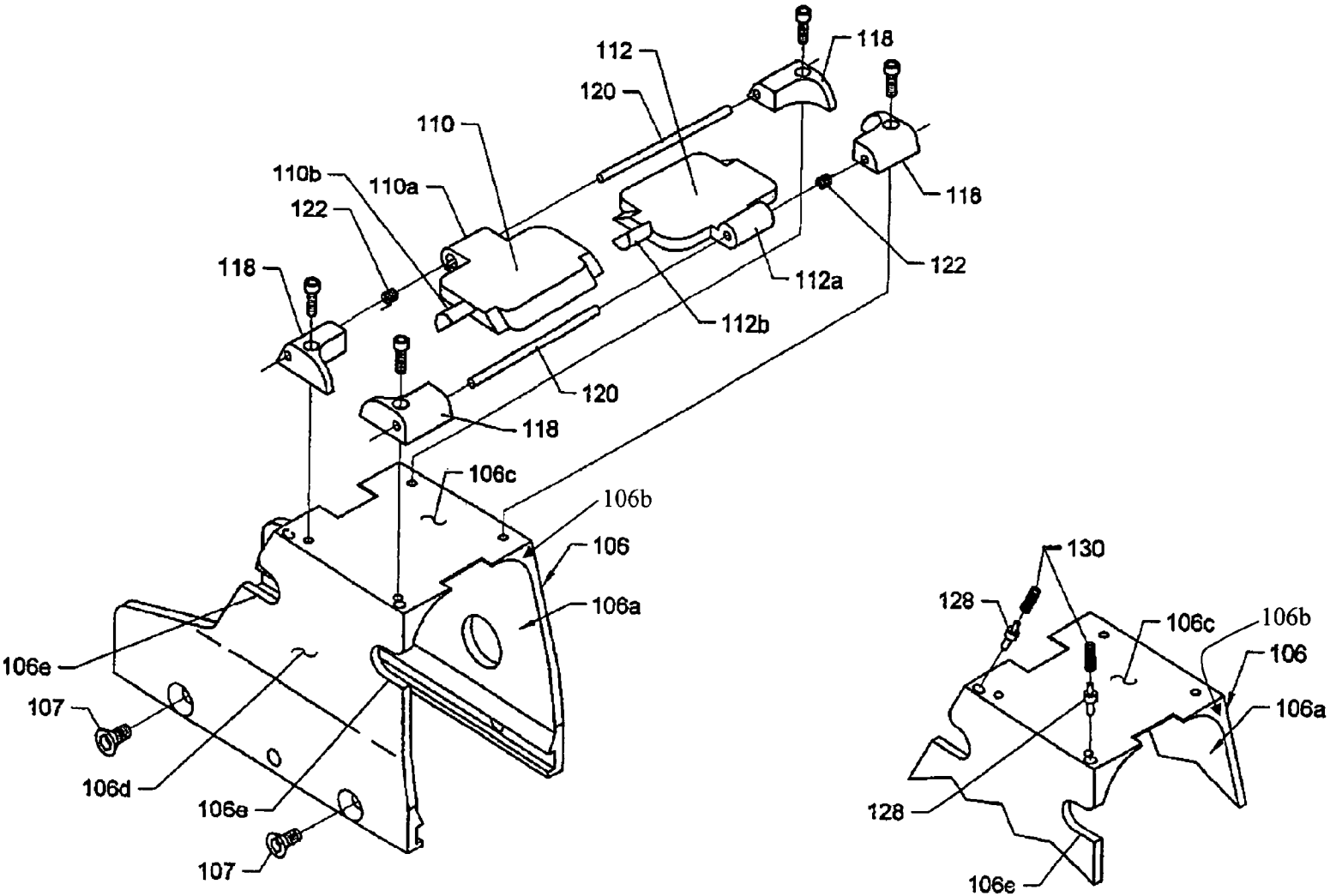
FIG. 3*a* is an exploded, three dimensional views of the structure of FIG. 2, further showing the components of the lens cover structure according to the present invention.
FIG. 3*b* is a partial, exploded, three dimensional view of certain components of the lens cover structure.

FIG. 1 schematically illustrates a firearm sight 100 with a lens cover structure 102 according to the present invention. The firearm sight 100 can be e.g. an EO Tech 511, 512, 551, or 552 type firearm sight which can be engaged with and disengaged from a male dovetail of a firearm, in a manner well known to those in the art. The sight device includes a rugged housing 106, with an optic 108 supported in the housing 106. The optic 108 preferably has a pair of lens 108*a* (FIG. 1 shows one lens 108*a*), and the housing 106 has a pair of lens openings 106*a*. The lens cover 102 is configured to selectively provide coverings for the lens openings 106*a* in the housing 106, in the manner described in more detail below.

Figure 4D:
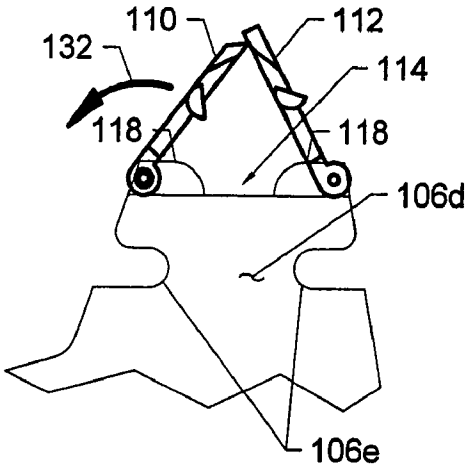
FIGS. 4*a*-4*e* schematically illustrate the manner in which a lens cover structure according to the present invention can be operated to cover the lens of a firearm sight.
Figure 4C:
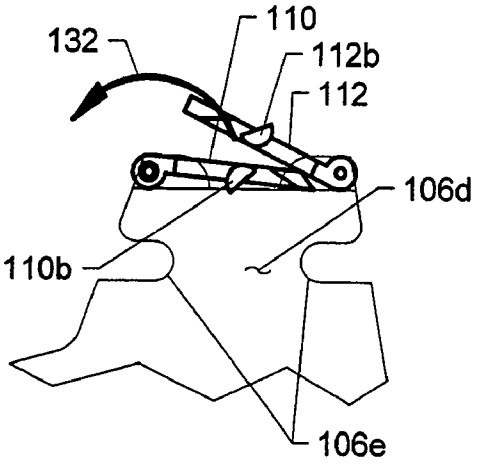
Figure 4E:
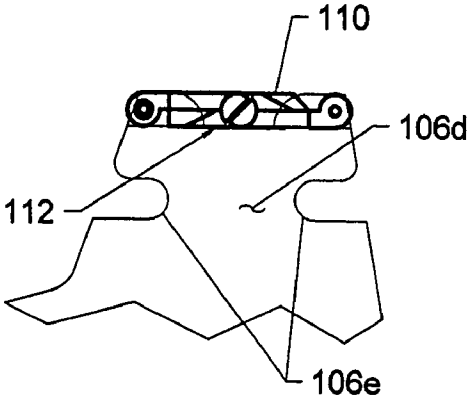
Figure 4A:
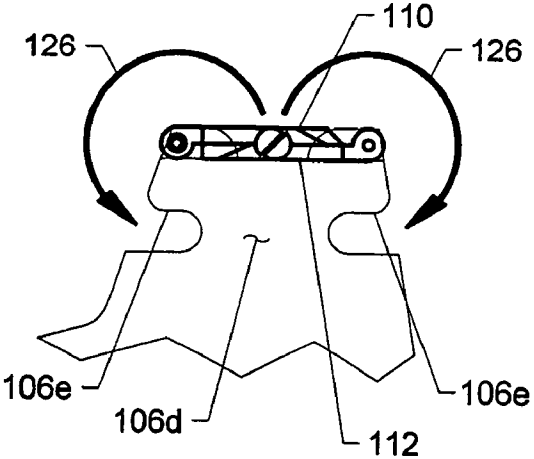
Figure 4B:
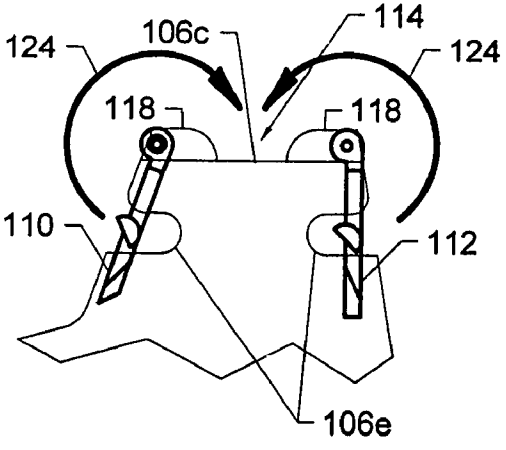
Figure 5:
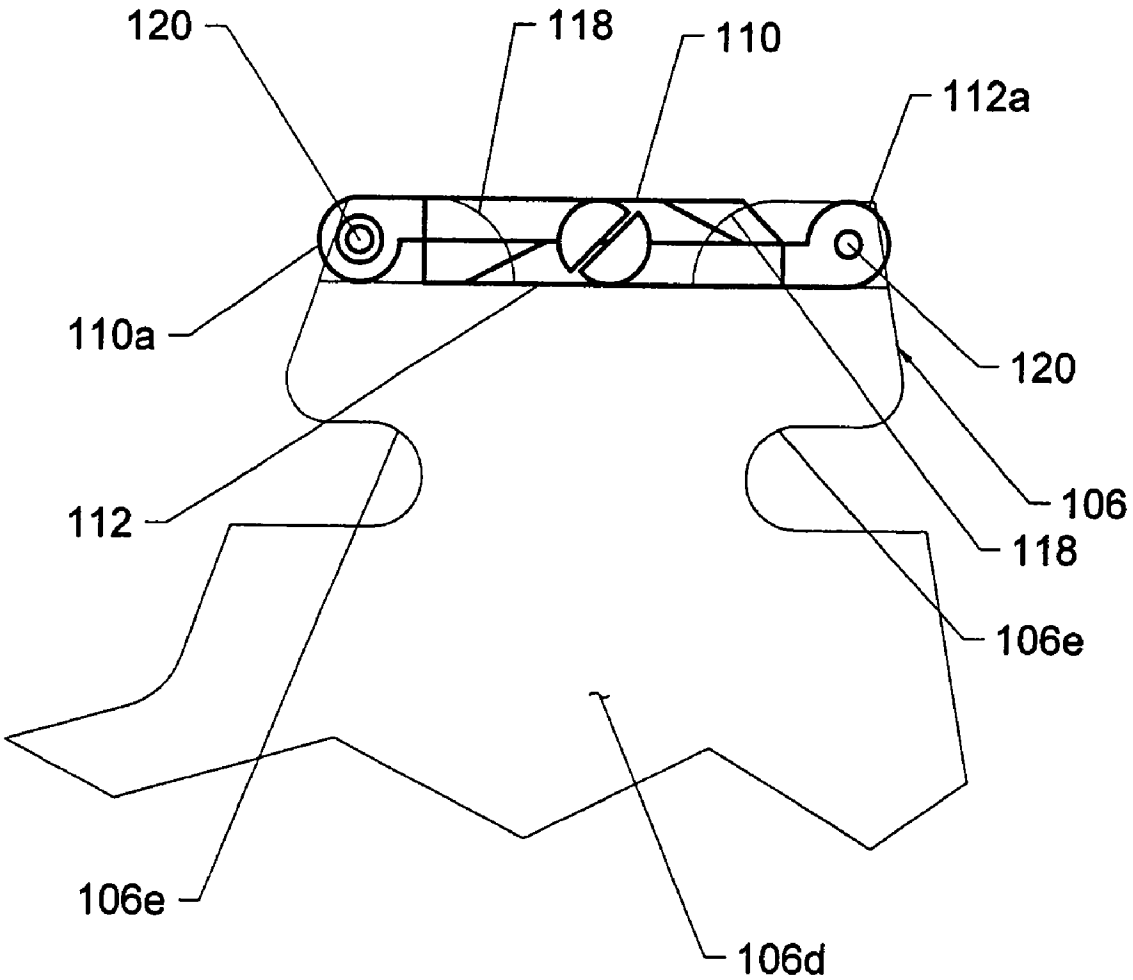
FIG. 5 is a schematic illustration of portions of the lens cover structure, that is generally similar to FIG. 4*e*, but on a larger scale.
Figure 6:
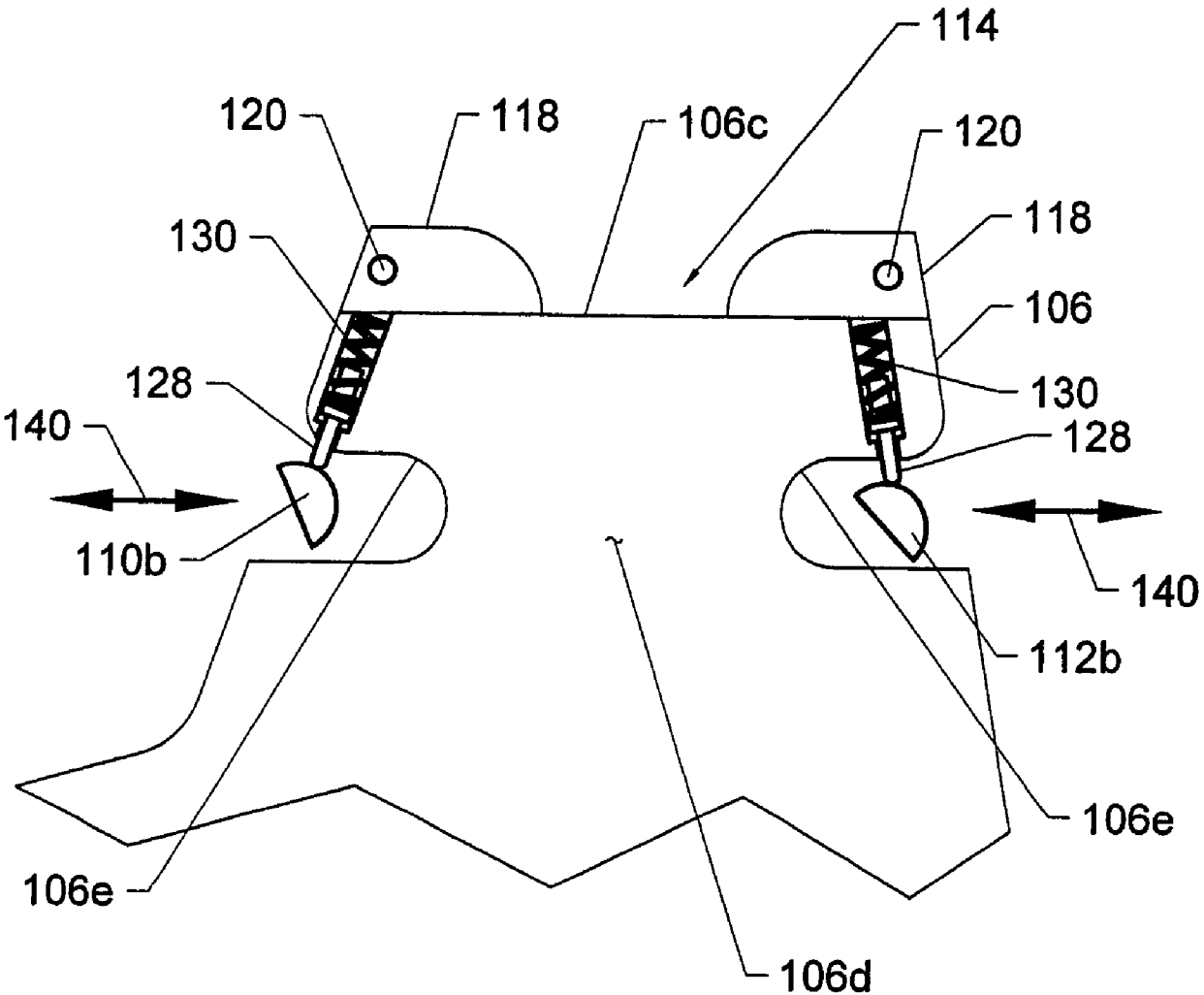
FIG. 6 schematically illustrates portions of the lens cover structure, as lens covers are being moved to positions in which they cover and uncover lens openings in a housing, according to the principles of the present invention.

The lens cover structure 102 comprises a pair of lens covers 110, 112, one for covering each lens opening (e.g. lens opening 106*a*). The housing 106 has a recess 114 that is formed on the top of the housing, for receiving the lens covers 110, 112 (FIGS. 4*b*, 4*d*, 6). The housing 106 comprises a main housing component 106*b* with a top surface 106*c*. A plurality of pivot bosses 118 are fixed to the main housing component 106*b* and extend upward from the top surface 106*c*. The pivot bosses 118 cooperate with the top surface 106*c* to provide the recess 114. The lens covers 110, 112 are preferably received in the recess 114 in the predetermined orientation shown in FIG. 1, 2, 4*a*, 4*e*, and 5, with the lens cover 110 stacked directly on top of the lens cover 112.

Each lens cover 110, 112 is spring biased toward the recess 114, and is moveable against its bias to a position in which it covers a respective lens opening (e.g. lens opening 106*a*). Pivot shafts 120 are supported by the pivot bosses 118, and the lens covers 110, 112 are pivotally supported by the pivot shafts 120. Encapsulated biasing springs 122 extend about the pivot shafts 120, and act between the pivot bosses 118 and the lens covers 110, 112. The biasing springs 122 bias the lens covers 110, 112 in the directions shown by arrows 124 in FIG. 4*b*, so that the lens covers are pivotally biased in a direction that locates them in the recess 114. The lens covers 110, 112 can be manually pivoted, against their spring bias, in the directions shown by arrows 126 in FIG. 4*a*, to move the lens covers 110, 112 to positions in which they cover the lens openings in the housing.

The recess 114 and the lens covers 110, 112 are configured such that (i) the lens covers 110, 112 can be received and oriented in the recess 114 in a predetermined relation with each other and (ii) the lens covers 110, 112 can be efficiently manipulated when they are not received in the recess in the predetermined relation to cause them to be reoriented and received in the recess in the predetermined order. Specifically, as described above, the lens covers 110, 112 are preferably received in the recess 114, with the lens cover 110 disposed directly on top of the lens cover 112, as shown in FIGS. 4*a* and 4*e*. The lens covers 110, 112 have respective sleeves 110*a*, 112*a* that are formed in one piece with the respective lens covers. The sleeves surround the pivot shafts 120, and as seen from FIGS. 4*a*-*e*, the sleeves 110*a*, 112*a* are offset in relation to the pivot axes of the shafts 110*a*, 112*a*, such that when the lens covers 110 and 112 are received in the recess 114 in the predetermined relation to each other, the lens covers will be directly stacked on top of each other in the recess 114, with lens cover 110 on top of lens cover 112. On the other hand, the lens cover structure is configured such that if the lens covers are received by the recess 114 in the opposite relation, i.e. with the lens cover 112 over, but not stacked directly on top of the lens cover 110 (see e.g. FIG. 4*c*), the lens covers can be simply and efficiently manipulated and reoriented so that they are received in the recess 114 in the predetermined relation, as described below.

Each lens cover 110, 112 has a finger tab 110*b*, 112*b*, respectively, positioned outboard of the lens cover 110, 112, and formed in one piece with the lens cover (the lens covers 110, 112 are preferably molded of synthetic plastic, and the finger tabs 110*b*, 112*b*, and pivot sleeves 110*a*, 112*a* are molded in one piece with the respective lens covers). The biasing springs 122 bias the lens covers 110, 112 in directions toward and into the recess 114 (i.e. in the directions shown by arrows 124 in FIG. 4*b*). Each finger tab 110*b*, 112*b* is configured to enable its lens cover to be manipulated to pivot the lens cover against its spring bias in the direction shown by arrows 126 in FIG. 4*a* and into a position in which it covers a respective lens opening in the housing. The housing 106 has side walls 106*d* with recesses 106*e*. Moreover, spring biased detents 128 extend through the housing walls and partially into the recess. The detents are biased by springs 130, and are configured so that a finger tab 110*b*, 112*b* on a lens cover can act on the detent 128 and push it against its spring bias as a lens cover is manipulated into covering relation with a lens opening. After the spring finger has passed the detent, the spring bias on the detent biases the detent to a position which it effectively captures the finger tab in the recess, until sufficient manual pressure is applied to the finger tab to again force the detent against its spring bias, and to allow the lens cover to be manipulated out of the recess 106*e*. In FIG. 6 the direction arrows 140 show the directions in which the finger tabs 110*b*, 112*b* are moved relative to the spring biased detents 128. Moreover, in FIG. 7, the finger tab 112*b* is shown in a position in which it is effectively trapped in recess 106*e* by the spring biased detent 128, and the finger tab 110*b* is shown in which it is not trapped in recess 106*e* by the spring biased detent 128 (i.e. the finger tab 110*b* is effectively untrapped). The finger tab can then be released, to allow the lens cover to pivot under its spring bias in the direction shown by arrows 124 in FIG. 4*b* and toward and into the recess. Thus, the finger tabs and detents are configured such that each finger tab can be manipulated to release its lens cover from the detent and allow the lens cover to pivot under its bias toward the recess 104. Moreover, it will be clear to those in the art that the foregoing structure enables the lens covers to be manipulated by the "offhand" (a shooters term describing the hand that is not responsible for fire control).

The finger tabs 110*b*, 112*b* are further configured such that when the lens covers are not received in the recess in the predetermined relation, the finger tabs are oriented such that finger pressure on one finger tab can simply and efficiently manipulate the lens covers in a manner that the lens covers are partially pivoted against their bias to a point where when the finger tabs are released the lens covers will pivot under their bias into the predetermined relation in the recess. Specifically, if the lens covers are received in the recess in the wrong relationship, i.e. in the relationship shown in FIG. 4*c*, with lens cover 112 on top of lens cover 110, the finger tab 110*b* on lens cover 110 is pivoted against its bias, in the direction shown by arrow 132 in FIGS. 4*c* and 4*d*. As seen from FIG. 4*d*, this simply and efficiently releases the lens covers from the wrong orientation, and as soon as the lens cover 110 clears lens cover 112, the finger tab 110*b* on lens cover 110 is released, and the lens covers will pivot under their spring bias, in the directions shown by arrows 124 in FIG. 4*b*, to the proper orientation shown in FIGS. 4*a* and 4*e*.

As described above, the housing 106 is preferably formed of a rugged material. For example, it is currently preferred to form the housing from aluminum such as 6061T6 aluminum, but it is also contemplated that the housing can be formed of carbon fiber material, plastic resin or other rugged materials. It is also contemplated that the lens covers, with pivot sleeves and finger tabs, can be formed in one piece (e.g. molded) from synthetic material such as Delrin or from hard rubber.

Accordingly, as seen from the foregoing detailed description, the present invention provides a lens cover structure that can simply and efficiently stores the lens covers, and enables the lens covers to be simply and efficiently manipulated to positions in which they cover the lens of a sight device. Moreover, the lens cover structure is designed so that if the lens covers are not stored in a predetermined relation with each other, they can be simply and efficiently manipulated to enable them to be stored in the preferred orientation to each other.

With the foregoing disclosure in mind, the manner in which the principles of the present invention can be used to design various types of lens covers, for various types of sight devices, will be apparent to those in the art.

What is claimed is:

1. Apparatus comprising a firearm sight having a housing with a pair of lens openings on opposite sides of the housing, and a pair of lens covers, one for each lens opening, the housing having a recess receiving the lens covers, each lens cover being biased toward the recess and being moveable against the bias on the lens cover to a position in which the lens cover covers a respective lens opening, wherein the recess and the lens covers are configured such that (i) the lens covers are received and oriented in the recess in a predetermined relation with each other and (ii) the lens covers can be efficiently manipulated when the lens covers are not received in the recess in the predetermined order to cause the lens covers to be reoriented and received in the recess in the predetermined relation;

wherein each lens cover is pivotally supported on the housing in a manner that enables the lens cover to be pivoted about a pivot axis toward and into the recess in the housing and to be pivoted about the pivot axis relative to the housing as the lens cover is moved against the bias on the lens cover and to a position in which the lens cover covers a respective lens, and wherein the lens covers are offset in relation to their pivot axes in a manner that enables them to be received and oriented in the recess in the predetermined relation, and oriented in a manner that enables the lens covers to be efficiently manipulated and reoriented when they are not received in the recess in the predetermined relation;

wherein each lens cover has a finger tab positioned outboard of the lens cover and formed in one piece with the lens cover, each finger tab configured to enable the lens cover having the finger tab to be manipulated to pivot the lens cover against the bias on the lens cover and into a position in which the lens cover covers a respective lens opening;

wherein the housing has a pair of integral detents, each of which is configured to engage a finger tab of a lens cover and hold the lens cover in position in which the lens cover covers a respective one of the lens openings, and wherein the finger tabs on each of the lens covers, and the pair of detents configured such that the finger tab on a lens cover can be manipulated to release the lens cover from one of the pair of detents and allow the lens cover to pivot under the bias on the lens cover toward the recess; and wherein the housing has recesses for receiving the finger tabs, and wherein the detents extend through detent openings in the housing and partially into the recesses that receive the finger tabs.

2. Apparatus as defined in claim 1, further including detent springs that bias the detents into predetermined positions in the recesses, and each of the detents is configured and oriented to be engaged by a respective one of the finger tabs against the spring bias on the detent to enable the finger tabs to extend into the recesses, and to enable each detent to return to the respective predetermined positions of that detent under the bias on that detent to maintain the finger tabs that has engaged the detent in position in the recesses.

3. Apparatus as defined in claim 1, wherein the housing comprises a main housing member, wherein the main housing member includes a top surface, and wherein the recess is partially formed by the top surface of the main housing member.

4. Apparatus comprising a firearm sight that comprises an optic with a pair of lens, and a housing located over the optic, the housing having a pair of lens openings on opposite ends of the housing, and a pair of lens covers, each associated with a respective one of the lens openings on opposite ends of the housing the housing having a recess with the pair of lens covers disposed in the recess with one lens cover disposed on top of the other lens cover, each lens cover being biased toward the recess and being moveable against the bias on the lens cover to a postion in which the lens cover covers a respective one of the lens openings.

5. Apparatus comprising a firearm sight that comprises an optic with a pair of lens, and a housing located over the optic, the housing having a pair of lens openings on opposite ends of the housing, and a pair of lens covers, each associated with a respective one of the lens openings on opposite ends of the housing, the housing having a recess with the pair of lens covers disposed in the recess with one lens cover disposed on top of the other lens cover, each lens cover being biased toward the recess and being moveable against the bias on the lens cover to a position in which the lens cover covers a respective one of the lens openings, wherein the housing comprises a main housing member, wherein the main housing member includes a top surface, and wherein the recess is partially formed by the top surface of the main housing member.

* * * * *